US006241634B1

(12) United States Patent
Armer, Jr.

(10) Patent No.: US 6,241,634 B1
(45) Date of Patent: Jun. 5, 2001

(54) SELF-PROPELLED ARROW

(76) Inventor: David L. Armer, Jr., P.O. Box 98, Golden, OK (US) 74737

( * ) Notice: Subject to any disclaimer, the term of this patent is extended or adjusted under 35 U.S.C. 154(b) by 0 days.

(21) Appl. No.: 09/628,748

(22) Filed: Jul. 31, 2000

Related U.S. Application Data

(60) Provisional application No. 60/146,161, filed on Jul. 30, 1999.

(51) Int. Cl.[7] ..... F42B 6/04
(52) U.S. Cl. ..... 473/581; 473/578; 124/57
(58) Field of Search ..... 124/57; 473/578, 473/581, FOR 216, FOR 218

(56) References Cited

U.S. PATENT DOCUMENTS 2,964,031 * 12/1960 Dotson ..... 124/57 X
4,478,202 * 10/1984 Anderson .
4,541,636 * 9/1985 Humphrey ..... 473/578
5,078,117 * 1/1992 Cover ..... 124/57 X
5,123,657 * 6/1992 Colt et al. .
5,183,259 * 2/1993 Lyon ..... 473/581
5,445,139 * 8/1995 Bybee ..... 124/23.1
5,610,365 * 3/1997 Thiesen ..... 102/431
5,650,589 * 7/1997 Thiesen ..... 102/431
5,836,842 * 11/1998 McLearan ..... 473/581
5,909,000 * 6/1999 Rakov ..... 124/57 X
6,059,677 * 5/2000 Breshears ..... 473/581

* cited by examiner

*Primary Examiner*—John A. Ricci
(74) *Attorney, Agent, or Firm*—John D. Gugliotia

(57) ABSTRACT

The present invention is a self-propelled arrow, consisting of an otherwise conventional hunting or target practice arrow that is propelled by $CO_2$ and water, thus providing additional thrust to the arrow when shot from a bow. String inertia causes a $CO_2$ filled cartridge to strike the point of a puncture means which punctures the cartridge and releases charged $CO_2$ into a water storage chamber which charges the water inside. The charged water becomes pressurized and actuates a pliable closure membrane to an open position in check valve fashion, thus releasing the pressurized water from the water storage chamber through the propellant jets in the rear of the arrow. This system accelerates the arrow and decreases the arrow drop, thereby increasing the range and speed of the arrow immensely. The $CO_2$ cartridges may be replaceable.

7 Claims, 4 Drawing Sheets

SELF-PROPELLED ARROW

RELATED APPLICATIONS

The present invention is a Continuation in Part of U.S. Provisional Patent No. 60/146,161, filed on Jul. 30, 1999. There are no other copending applications, nor any previously filed applications anywhere in the world.

BACKGROUND OF THE INVENTION

1. Field of the Invention

The present invention relates generally to archery equipment, and, more particularly, to a self-propelled arrow.

2. Description of the Related Art

The hobby of bow hunting or bow target shooting has been enjoyed by many. It is a hobby where skill is constantly employed and continual practice will continually improve a participant. However, it does have some drawbacks when compared to other similar hobbies using firearms. Perhaps the largest drawback is that of range capabilities. When arrows are launched from a bow, crossbow or other similar device, they quickly loose speed. As speed is lost, the arrow drops in its flight path and thus accuracy is affected as well. Another problem is that of a lack of thrust or penetrating power when the arrow finally reaches its target due to slow arrow speeds. While this is not a great concern while target practicing, it does become an issue while hunting. The lack of penetrating power may not allow for an instant kill of an animal and cause the animal to flee with the arrow attached. The hunter is then faced with subsequent tracking of the animal as it can live for several hours after being hit, depending upon the accuracy of the hunter's shot. When this occurs, several things could happen. The game could run so far and so fast that the hunter never catches up to it, or the wounded animal could be attacked by other wild animals, ruining the meat.

A search of the prior art did not disclose any patents that read directly on the claims of the instant invention; however, the following references were considered related:

U.S. Pat. No. 5,836,842, issued in the name of McLearan;

U.S. Pat. No. 5,123,657, issued in the name of Colt et al.;

U.S. Pat. No. 5,650,589, issued in the name of Thiesen;

U.S. Pat. No. 5,610,365, issued in the name of Thiesen;

U.S. Pat. No. 5,445,139, issued in the name of Bybee; and

U.S. Pat. No. 4,478,202, issued in the name of Anderson.

Consequently, the need has developed for a means by which bow hunters and target shooters can increase their range, accuracy and speed of their arrows in an efficient manner.

SUMMARY OF THE INVENTION

The present invention is a self-propelled arrow, consisting of an otherwise conventional hunting or target practice arrow that is propelled by $CO_2$ and water, thus providing additional thrust to the arrow when shot from a bow.

String inertia causes a $CO_2$ ampule to strike a water storage chamber, charging the water, and thus releasing the pressurized water through propellant jets in the rear of the arrow. This system accelerates the arrow and decreases the arrow drop, thereby increasing the range and speed of the arrow immensely. The $CO_2$ cartridges may be replaceable.

It is an object of the present invention to provide an arrow that accelerates after being fired, thus increasing distance and reducing downward tipping of the arrow in flight.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
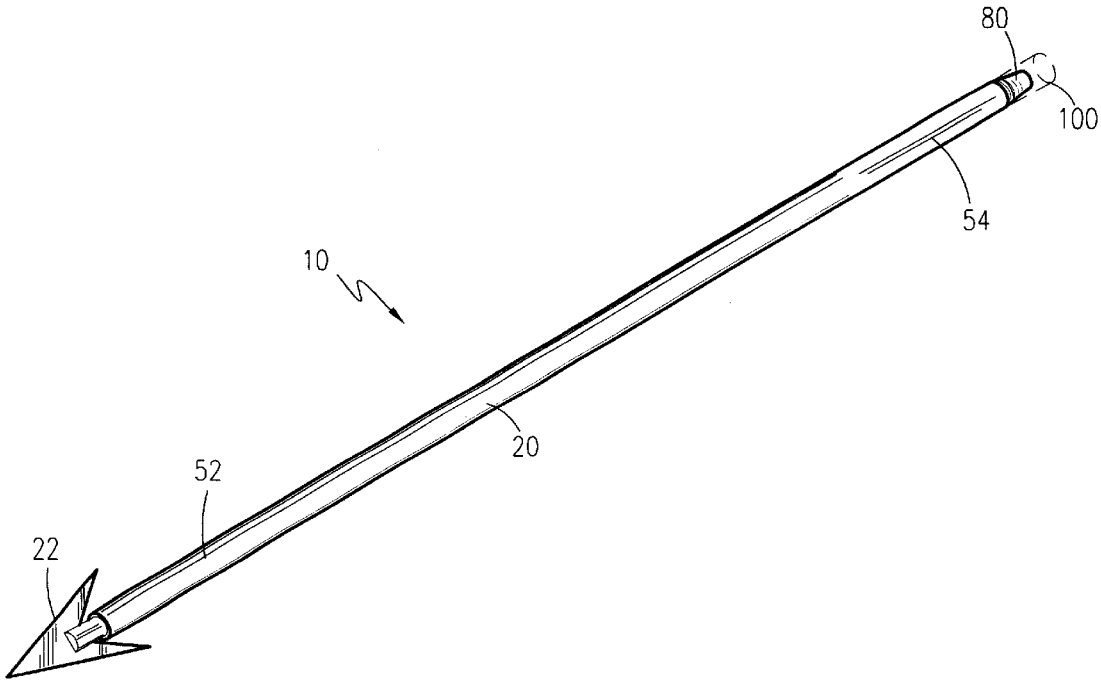
FIG. 1 is a perspective view of a self-propelled arrow according to the preferred embodiment of the present invention.
Figure 2:
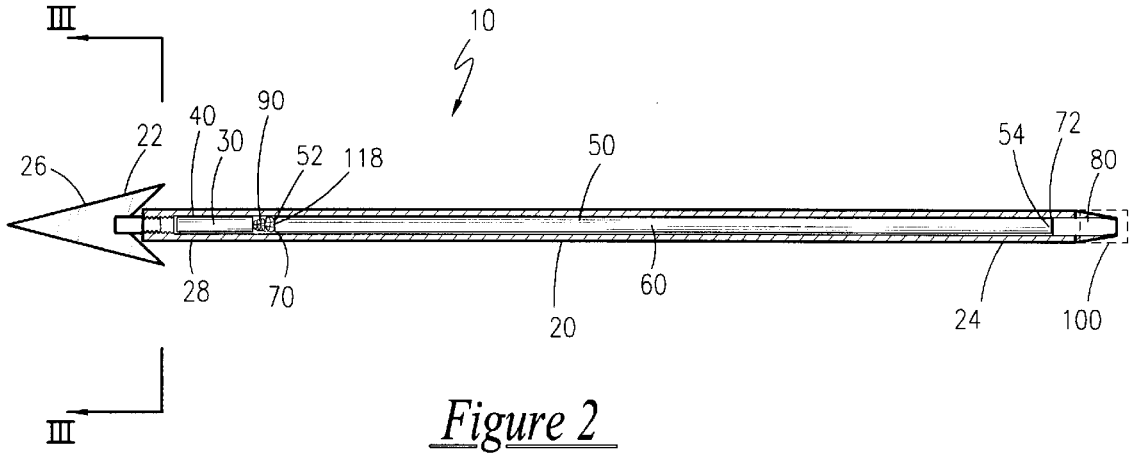
FIG. 2 is a cross-sectional view thereof.
Figure 3:
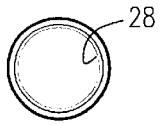
FIG. 3 is a cross-sectional view taken along lines III—III of FIG. 2.
Figure 4:
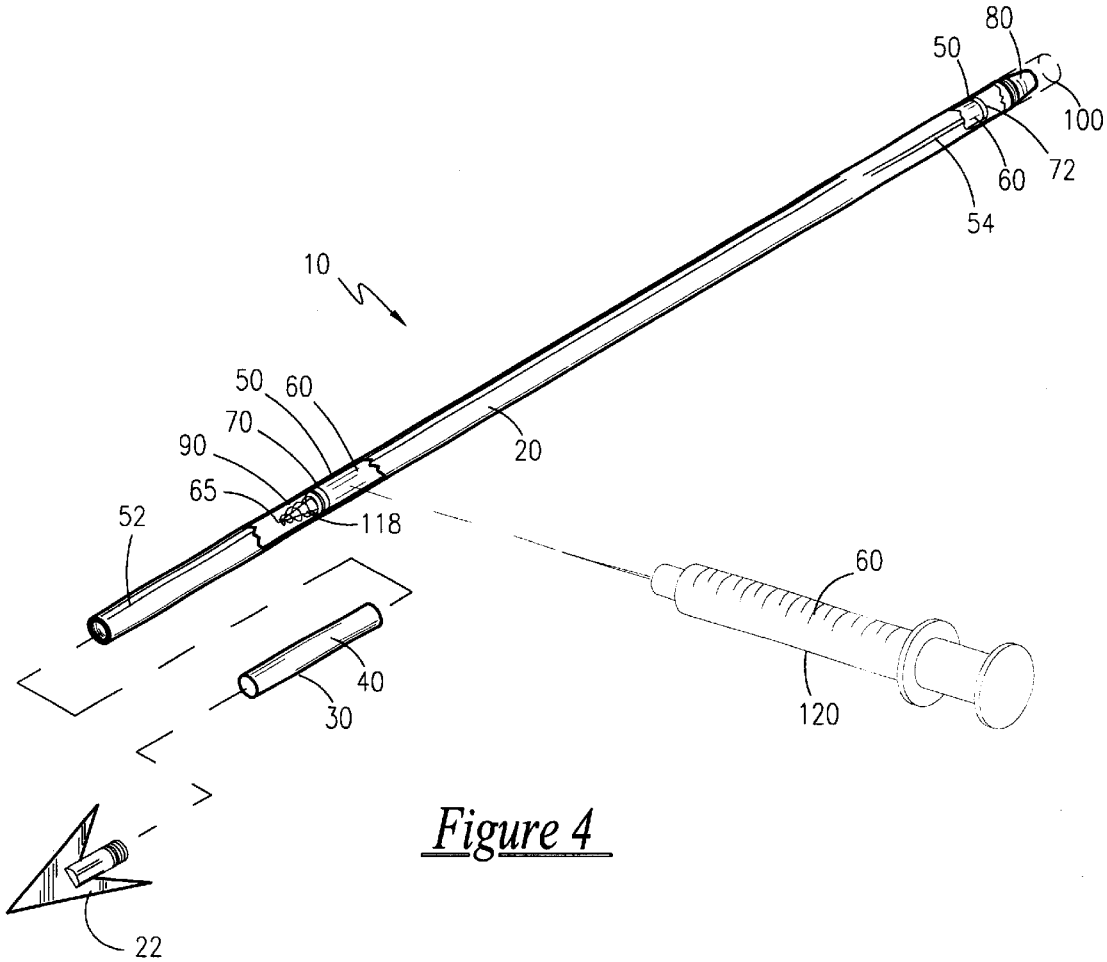
FIG. 4 is an exploded perspective view of the self-propelled arrow according to the preferred embodiment of the present invention.

The best mode for carrying out the invention is presented in terms of its preferred embodiment, herein depicted within the Figures.

1. Detailed Description of the Figures

Referring now to FIGS. 1–4, a self-propelled arrow 10 is disclosed, designed as an otherwise conventional arrow that is propelled by $CO_2$ and water 60, thus providing additional thrust to the arrow 20 when shot from a bow.

The present invention is comprised of an otherwise conventional, linearly elongated, cylindrical arrow 20 having a forward end 22 opposite a rear end 24. Located at the forward end 22 of the arrow 20 is an arrow tip receiving neck 28. The arrow tip receiving neck 28 is a threaded, circular opening designed to have an arrow tip 26 removably coupled thereto. The arrow 20 has a hollow interior volume.

A water storage chamber 50, designed to hold water 60 therein, is located inside the arrow 20, axially oriented, and extends a linear length from the rear end 24 just beyond a linearly elongated centerline to the forward end 22 of the arrow 20. The water storage chamber 50 is configured so as to be slidably received inside of the arrow 20 along a radial centerline thereof. The water storage chamber 50 further includes a small aperture 118 formed along an external circumferential surface near an upper end 52 thereof below a first pliable closure membrane 70 (as will be described in greater detail below) for delivering water 60 therethrough. The water storage chamber 50 is filled with water 60 by a water-delivery means 120 such as a syringe with needle, or other suitable means for delivering water 60 inside the water storage chamber 50.

The first spherical, pliable closure membrane 70, located on the upper end 52 of the water storage chamber 50, is moved by a rearward thrust of charged $CO_2$ between open and closed positions in check valve fashion.

A second spherical, pliable closure membrane 72, located on a lower end 54 of the water storage chamber 50, separates the water storage chamber 50 from propellant jets 80.

The propellant jets 80 are formed at the rear end 24 of the arrow 20, posterior to the pliable closure membrane 72, and have external circumferential sidewalls converging inwardly with increased distance from the pliable closure membrane 72. The pliable closure membrane 72 is moved by water 60 flow between open and closed positions in check valve fashion. When the pliable closure membrane 72 on the lower end 54 of the water storage chamber 50 is in an open position, the water storage chamber 50 is in fluid communication with the propellant jets 80. The propellant jets 80 have a hollow, circular, threaded cap 100 mounted to an upper end thereof, so as to be held by a threaded connection to a tip of any arrow, thereby allowing the present invention to be removably attached to any typical arrow used in bow hunting.

A replaceable cartridge 30, containing a pressurized gas 40 such as $CO_2$, is designed to be slidably inserted and positioned inside the arrow 20, posterior to the arrow tip 22, where the cartridge 30 comes to rest against a spring safety means 90. The spring safety means 90 is affixed along a perimeter of an upper end of the first pliable closure member 70, located at the 52 top end of the water storage chamber 50, and includes a pointed, puncture means 65 resting therein, extending from the top end 52 of the water storage chamber 50 a linear distance just short an upper end of the spring safety means 90. The spring safety means 90 prevents the cartridge 30 from striking the water storage chamber 50 except during firing of the arrow 20.

The present invention is designed so that string inertial force, created during the firing of the arrow 20 from a bow, causes the $CO_2$ pressurized cartridge 30 to be thrust rearward and strike the point of the puncture means 65, thereby puncturing the cartridge 30 and releasing charged $CO_2$ into the water storage chamber 50, wherein the water 60 therein becomes pressurized. The pressurized water 60 actuates the pliable closure membrane 72 to an open position in check valve fashion, and releases pressurized water 60 therefrom through the propellant jets 80. This $CO_2$/water propulsion system is designed to accelerate the arrow 20 and decrease the arrow 20 drop, thereby increasing the range and speed of the arrow 20.

After the charged $CO_2$ has entered the water storage chamber 50, the first pliable closure membrane 70 is actuated to a closed position in check valve fashion. Similarly, after all pressurized water 60 has been released through the propellant jets 80, the second pliable closure membrane 72 is actuated to a closed position in check valve fashion, thereby placing the present invention in condition for being fired once again. At this point, a user removes the used $CO_2$ cartridge 30 and inserts and positions another $CO_2$ cartridge inside the arrow 20, posterior to the arrow tip 22, and fills the water storage chamber 50 with water 60, via the water-delivery means 120.

Figure 5:
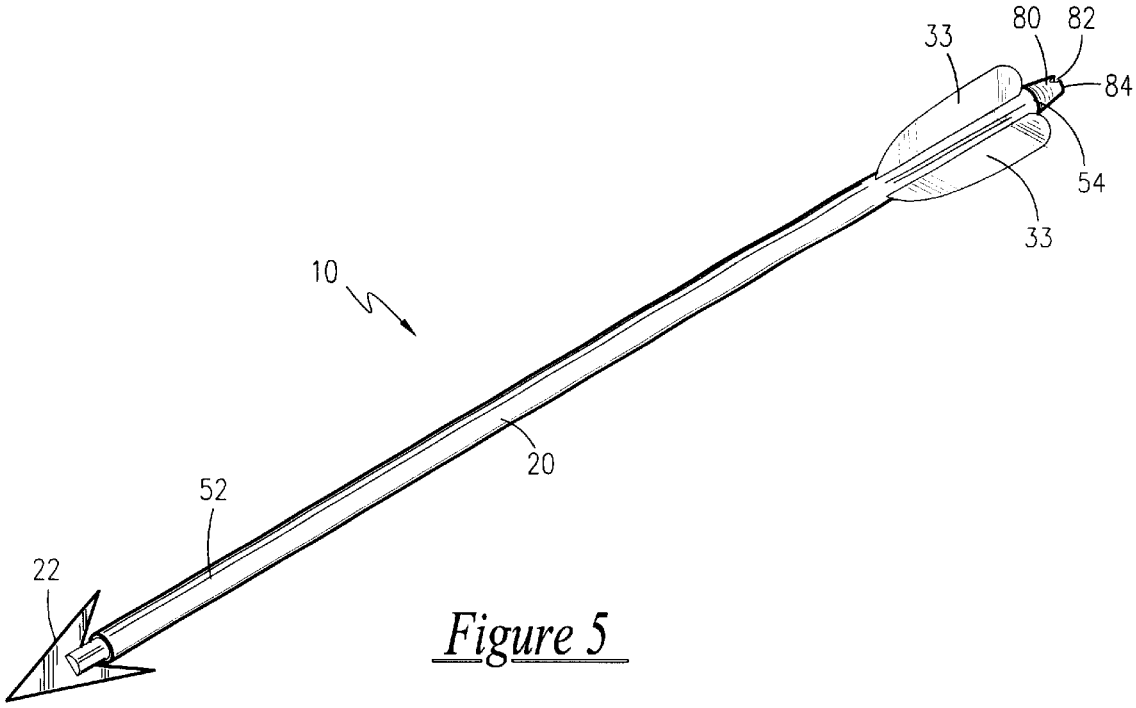
FIG. 5 is a perspective view according to an alternate embodiment of the present invention.
Figure 6:
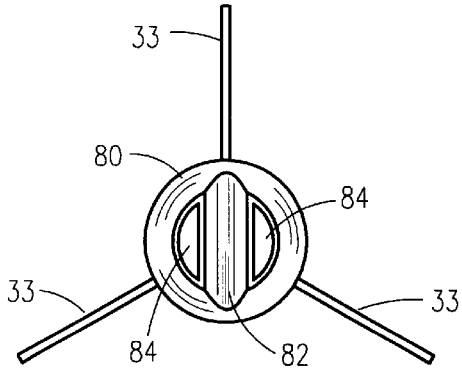
FIG. 6 is a is a rear view thereof.

Referring now to FIGS. 5 and 6, an alternate embodiment of the present invention is shown wherein a complete arrow 20 is utilized. The alternate embodiment comprises an arrow 20 having a plurality of arrow guide fins 33 mounted to an external circumferential surface at the rear end 24 thereof. The alternate embodiment further includes propellant jets 80 having a V-shaped recess 82 formed at an end thereof, dividing the propellant jets 80 into two water propulsion channels 84 and also serving as a bow string guiding means for launching the arrow 20. The alternate embodiment is identical in all other aspects of the preferred embodiment of the present invention, excluding the threaded cap 100 mounted to an upper end of the propellant jets 80.

It is envisioned that other styles and configurations of the present invention can be easily incorporated into the teachings of the present invention, and only one particular configuration shall be shown and described for purposes of clarity and disclosure and not by way of limitation of scope.

2. Operation of the Preferred Embodiment

To use the present invention, the user fills the water storage container 50 with water 60 via the water-delivery means 120, and slidably inserts the water storage container 50 inside of the arrow 20. Next, the user slidably inserts a $CO_2$ cartridge 30 inside the arrow 20 where it comes to rest against the spring safety means 90, and secures an arrow tip 22 to the forward end 22 of the arrow 20. The user then removably secures the rear end 24 of the arrow 20 via the threaded cap 100 to the tip of an arrow. Finally, the user fires the arrow 20 in the customary manner as when firing a bow and arrow.

The foregoing description is included to illustrate the operation of the preferred embodiment and is not meant to limit the scope of the invention. The scope of the invention is to be limited only by the following claims.

What is claimed is:

1. A self-propelled arrow comprising:

an otherwise conventional, linearly elongated, cylindrical arrow shaft with an interior volume having a forward end opposite a rear end;

an arrow tip terminating said forward end of said arrow shaft;

propellant discharge orifice formed at said rear end of said arrow shaft;

a water storage chamber for holding water and located inside said interior volume at said forward end;

a replaceable cartridge containing a pressurized gas, said replaceable cartridge slidably inserted and positioned inside said interior volume forward said water storage chamber immediately adjacent to said arrow tip;

a first spherical, pliable closure membrane located on an upper end of said water storage chamber;

a second spherical, pliable closure membrane located on a lower end of said water storage chamber, and a spring safety means affixed along a perimeter of an upper end of the first pliable closure member for preventing said cartridge from striking said water storage chamber except during firing of said arrow, wherein said spring safety means has a pointed, puncture means resting inside said spring safety means directed at said first pliable closure membrane.

2. The self-propelled arrow of claim 1, wherein when said cartridge is thrusted rearward and strikes a point of said puncture means by inertial force upon firing said arrow with a bow, said cartridge is punctured and releases charged $CO_2$ into said water storage chamber, wherein said water becomes pressurized water.

3. The self-propelled arrow of claim 2, wherein said pressurized water actuates said second spherical, pliable closure membrane to said open position in check valve fashion, and releases said pressurized water from said second spherical, pliable closure membrane through said propellant jets.

4. The self-propelled arrow of claim 3, wherein said first spherical, pliable closure membrane is actuated to a closed position in check valve fashion after charged $CO_2$ has entered said water storage chamber, said second spherical, pliable closure membrane is actuated to a closed position in check valve fashion after all pressurized water 60 has been released through the propellant jets.

5. The self-propelled arrow of claim 1, wherein said arrow has an arrow tip receiving neck located at said forward end of said arrow, said arrow tip receiving neck having a threaded, circular opening designed to have said arrow tip removably coupled thereto.

6. The self-propelled arrow of claim 1, wherein said water storage chamber is slidably received inside of said arrow along a radial centerline of said arrow, said water storage chamber has a small aperture formed along an external circumferential surface near said upper end of said water chamber, below said first pliable closure membrane for delivering water through said aperture.

7. The self-propelled arrow of claim 1, wherein said propellant jets have external circumferential sidewalls converging inwardly with increased distance from said second spherical, pliable closure membrane, and said propellant jets have a hollow, circular, threaded cap mounted to an upper end of said propellant jets, so as to be held by a threaded connection to a tip of any arrow.

* * * * *